US006883270B2

(12) United States Patent
Davis

(10) Patent No.: US 6,883,270 B2
(45) Date of Patent: Apr. 26, 2005

(54) CHRISTMAS TREE STAND

(76) Inventor: John H. Davis, 3796 Stewart Rd., Eugene, OR (US) 97402

( * ) Notice: Subject to any disclaimer, the term of this patent is extended or adjusted under 35 U.S.C. 154(b) by 0 days.

(21) Appl. No.: 10/654,312

(22) Filed: Sep. 3, 2003

(65) Prior Publication Data

US 2005/0044784 A1 Mar. 3, 2005

(51) Int. Cl.[7] ..... A47G 33/12; A47G 7/02
(52) U.S. Cl. ..... 47/40.5; 47/84; 248/689
(58) Field of Search ..... A47G 33/12; 47/40.5, 47/84; 248/689; 224/547; 74/551; 24/455

(56) References Cited

U.S. PATENT DOCUMENTS 1,325,564 A * 12/1919 Herman ..... 74/550
1,371,319 A * 3/1921 Manlond ..... 248/37.3
1,622,028 A * 3/1927 Coultas ..... 74/551
2,181,788 A * 11/1939 Maas ..... 74/551
3,521,332 A * 7/1970 Kramer ..... 403/188
4,006,560 A * 2/1977 Schulz ..... 47/40.5
4,477,049 A * 10/1984 Davis ..... 248/524
4,920,592 A * 5/1990 Scott ..... 7/100
5,137,246 A * 8/1992 Idso ..... 248/523
5,301,462 A * 4/1994 Hronyetz ..... 47/40.5
5,522,177 A * 6/1996 Davis ..... 47/40.5
6,019,341 A * 2/2000 Brown et al. ..... 248/516
6,477,744 B1 * 11/2002 Miles ..... 24/3.12
6,568,127 B1 * 5/2003 Kalman et al. ..... 47/40.5

FOREIGN PATENT DOCUMENTS

DE 29814017 U * 8/1998

* cited by examiner

*Primary Examiner*—Robert P. Swiatek
*Assistant Examiner*—Andrea M. Valenti
(74) *Attorney, Agent, or Firm*—Olson & Olson

(57) ABSTRACT

The Christmas tree stand of this invention includes an annular ring base supporting a central upright post having a tree trunk set pin at its bottom end and a transverse opening adjacent its top end for receiving the screw thread end of a screw crank for threading into the side of a tree trunk. The screw crank extends from the screw thread end to an intermediate angular bend which includes an arcuate portion providing an impact anvil aligned with the screw thread for striking by a hammer to set the screw thread into the side of a tree trunk. The screw crank is secured releasably to the ring base for storage, by a socket member secured to the ring base for receiving the screw thread end and by an angular clip member secured to the ring base to capture an intermediate portion of the screw crank.

6 Claims, 3 Drawing Sheets

CHRISTMAS TREE STAND

BACKGROUND OF THE INVENTION

This invention relates to Christmas tree stands, and more particularly to a Christmas tree stand construction that facilitates stacking in multiples for shipment in large quantities to dealers and distributors.

The Christmas tree stand of this invention is an improvement over my earlier stand disclosed in U.S. Pat. No. 5,522,177 by providing means for securing the screw crank component to the main body of the stand for stacking, shipment and storage.

My earlier patent referred to above is incorporated herein by reference, and it is to be noted that no means is provided for securing the screw crank firmly to the main body of the stand. The screw crank thus may be misplaced and therefore unavailable for use in securing a tree to the stand. The present invention provides that removable attachment to the main body.

SUMMARY OF THE INVENTION

The Christmas tree stand of this invention incorporates with the main stand body of my earlier patent an arrangement of securing means attached to the ring base of the stand by which to removably secure the screw crank component of the stand while still affording stacking for shipment and storage.

It is the principal objective of this invention to provide a Christmas tree stand of the class described to which the screw crank component is secured removably to the stand body for storage and transport.

Another objective of this invention is the provision of a Christmas tree stand of the class described in which the screw crank component is secured removably to the main body of the stand while affording stacking of the stand in multiples for convenient shipping to dealers and distributors and storage as inventory.

Still another objective of this invention is to provide a Christmas tree stand of the class described to which the screw crank component is secured removably for storage by the end user.

A further objective of this invention is the provision of a Christmas tree stand of the class described which is of simplified construction for economical manufacture and is operable with facility to support a Christmas tree adjustably and positively.

The foregoing and other objects and advantages of this invention will appear from the following description, taken in connection with the accompanying drawings of a preferred embodiment.

DESCRIPTION OF THE PREFFERED EMBODIMENT

Figure 1:
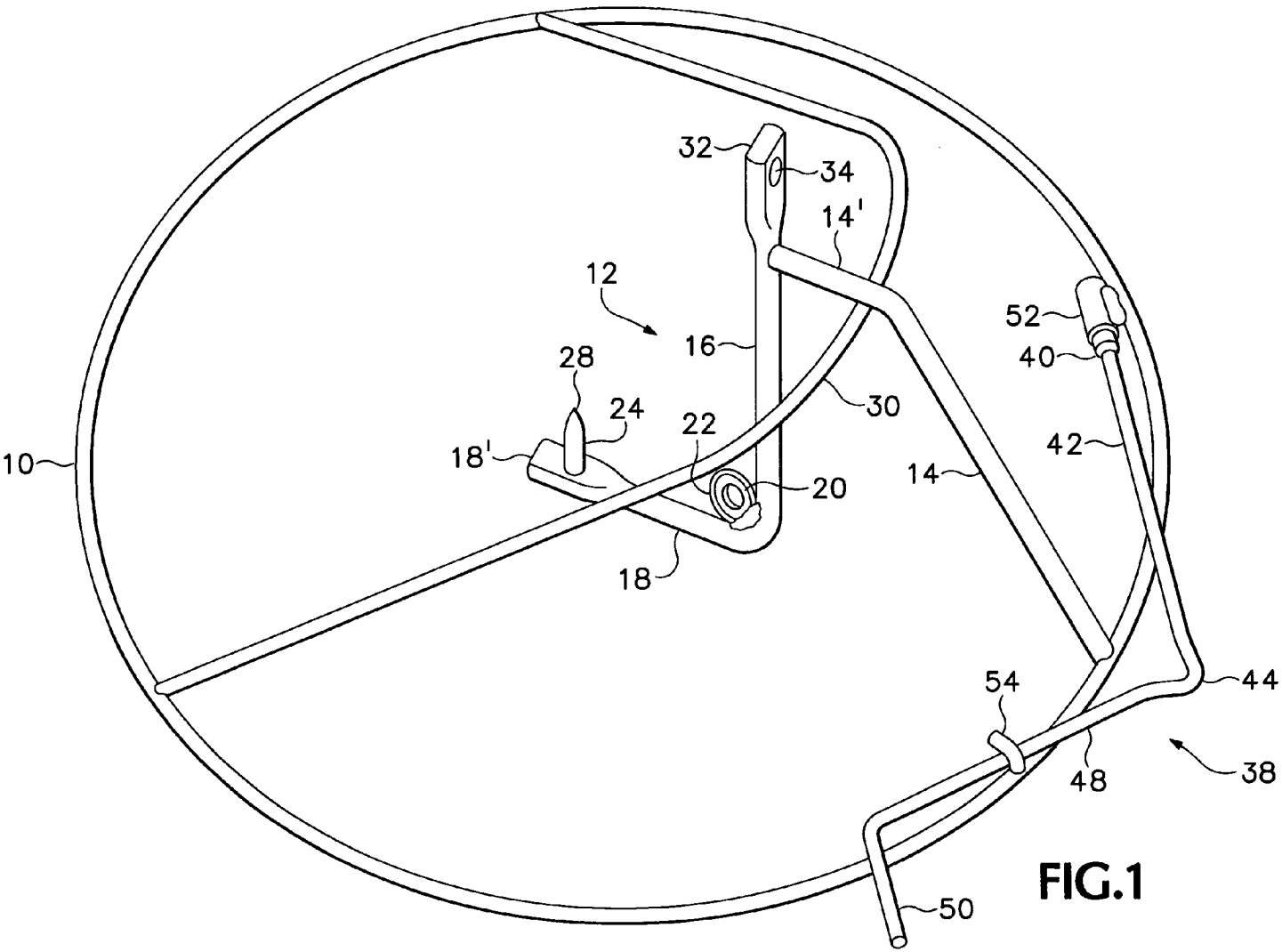
FIG. 1 is a top perspective view of the Christmas tree stand disclosed in my earlier patent identified hereinbefore and further illustrates the novel screw crank and retainer components of this invention.

The Christmas tree stand of this invention relates to my earlier stand disclosed in U.S. Pat. No. 5,522,177 identified hereinbefore and incorporated herein by reference. This invention provides a novel screw crank configuration and removable attachment of the screw crank to the main tree stand body while affording stacking of multiple stands for quantity shipment and storage.

Briefly, the Christmas tree stand described in my patent aforesaid comprises a metal base ring 10 which supports a Christmas tree holding assembly 12 comprised of the inclined support rod 14 secured at its bottom end, as by welding, to the base ring 10. The upper segment 14' of the support rod is bent to horizontal and its free end is welded to the upright post 16 adjacent the upper end thereof.

A foot plate 18 is formed integral with or otherwise secured to the bottom end of the post 16, and is reinforced by gusset 20. The gusset preferably is formed with a tapered, sharpened upper edge 22, to facilitate penetration into the bottom end of a Christmas tree C. A set pin 24 extends through an opening in the flattened end portion 18' of the foot plate 18. The bottom end of the set pin is provided with an enlarged head 26 for contact by a hammer for driving the pin into the bottom end of the Christmas tree C. This is facilitated by the taper 28 at the upper end of the pin 24.

A U-shaped brace 30 is secured at its free ends to the base ring 10 and at its closed intermediate end to the support 14', for reinforcing the support segment.

The upper end of the post 16 preferably is flattened, at 32, and provided with an opening 34 therethrough for freely receiving the screw end 36 of a screw crank 38 which forms a portion of the present invention. The screw end of the crank has an adjacent enlarged abutment 40 which serves to engage the flattened end portion 32 of the post 16, to enable the screw 36 to draw the Christmas tree C into firm abutment with the post 16, as explained more fully hereinafter.

The crank segment 42 of the screw crank 38 extends from the abutment 40 to an intermediate arcuate bend 44 configured with an enlarged radius to provide an anvil 46 in axial alignment with the crank segment 42 and screw 36. A hammer thus may be impacted against the anvil 46 to drive the screw 36 into the side of a Christmas tree C a short distance to set the screw into the tree.

A second segment 48 of the screw crank 38 extends from the arcuate bend 44 to the handle end segment 50 of the screw crank for rotating the latter, to effect screwing the screw end 36 into the side of the Christmas tree until the abutment 40 engages the flattened end 32 of the post 16 and draws the Christmas tree C into firm engagement with the post 16.

As previously explained, novel means is provided for securing the screw crank 36 releasably to the Christmas tree base ring 10, to retain the screw crank with the main body of the Christmas tree stand when not in use, as during shipment to dealers and distributors and when the ultimate user stores the stand after the Christmas season has ended and the stand is removed from the tree. Further, the present invention provides for such storage with the associated Christmas tree stand body while still enabling the stacking of a plurality of stands for shipment to dealers and distributors and storage in a minimum of space.

Figure 2:
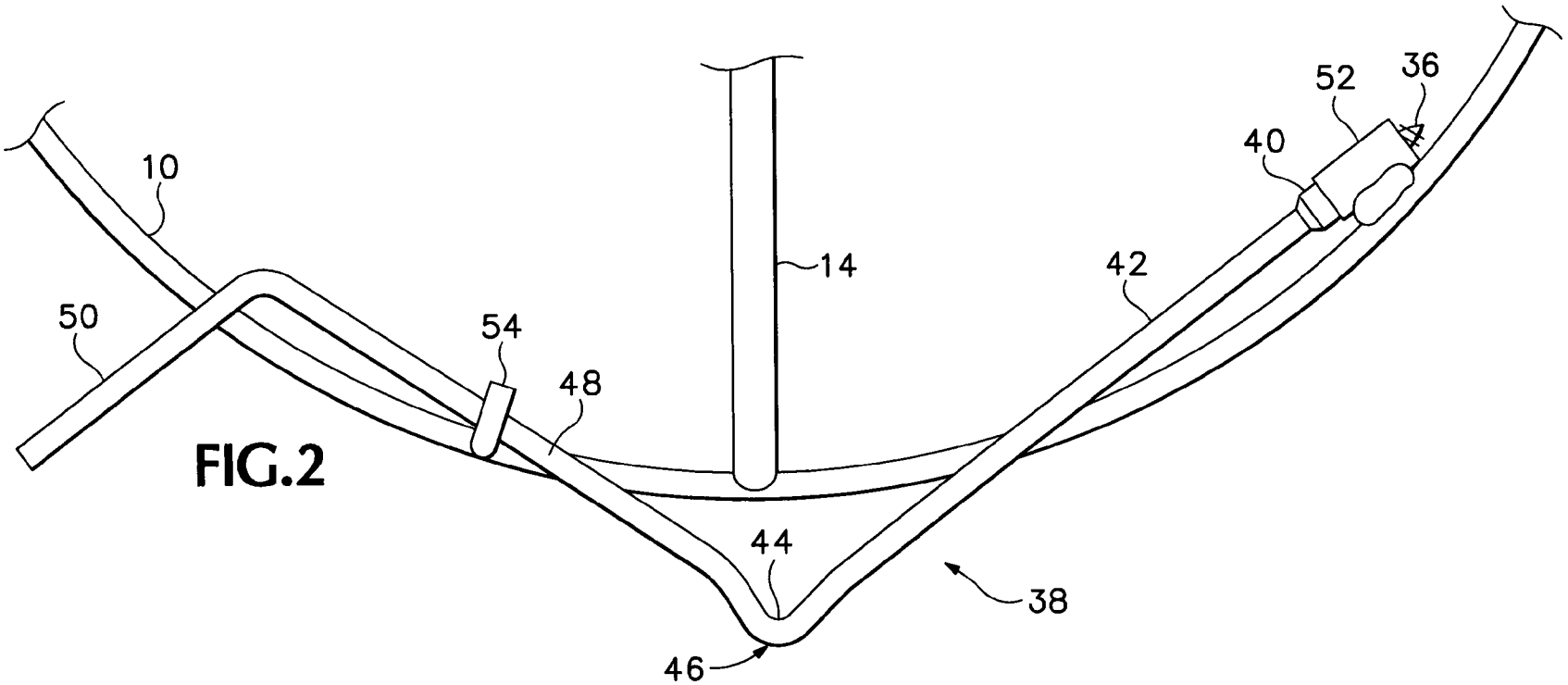
FIG. 2 is a fragmentary plan view of the novel screw crank component retained releasably on the base ring component of the tree stand.

As illustrated in FIGS. 1 and 2 of the drawings, the screw crank retainer includes a tubular socket 52 welded or otherwise secured to the base ring 10 for freely receiving the screw 36, with the abutment engaging the open end of the socket. The socket is arranged so that the segments of the screw crank 38 traverse the base ring 10 in a zigzag pattern, for support. An angular clip 54 is welded or otherwise secured to the ring 10 in position for retaining the second segment 48 of the screw crank 38. The clip 54 is configured to receive the second segment 48 under it by pressing downwardly on the segment while slipping it under the free end of the clip 54. When the downward pressure is relieved from the segment 48, it returns resiliently to its normal state and thus is captured under the angular clip 54.

The two positions of retention of the screw end 36 and second segment 48 thus locates the screw crank 38 closely adjacent the circular base ring 10 and allows vertical stacking of a plurality of Christmas tree stands in significant numbers to facilitate economical shipping and storage, while ensuring retention of the screw crank with each Christmas tree stand body. The ultimate user also retains the screw crank positively with the tree stand body, for storage in the off season, and thus ensures against the loss of the screw crank by inadvertent misplacement.

Figure 3:
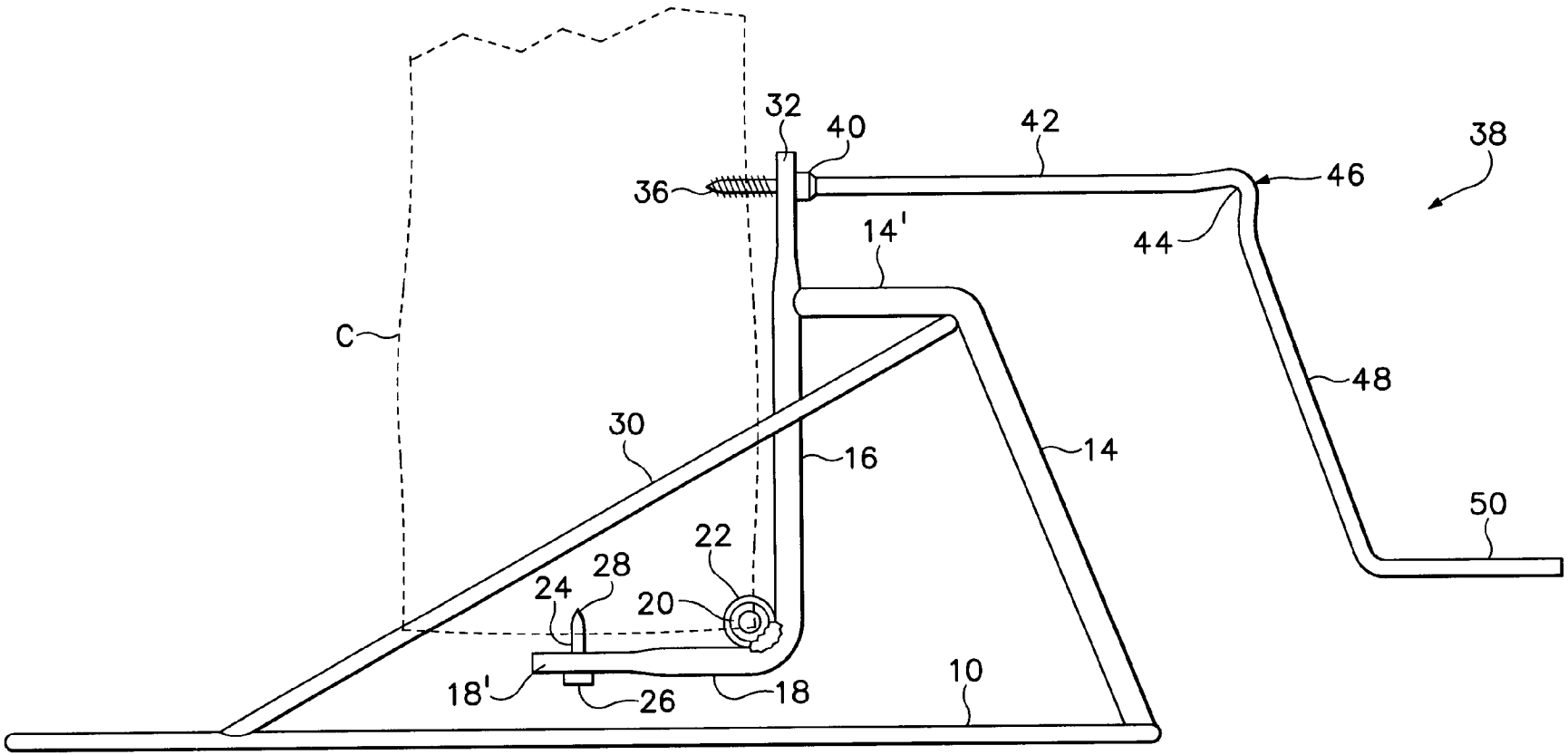
FIG. 3 is a side elevation of the Christmas tree stand of FIG. 1 showing the operation of the screw crank embodying the features of this invention.

Mounting of a Christmas tree C on the tree stand described hereinbefore is described in detail in my earlier patent referenced hereinbefore. In brief, the Christmas tree is laid horizontally and the bottom end is cut square. The stand body is moved to encompass the base end of the tree, between the spaced ends of the brace rod 30, and the post 16 is moved closely adjacent the side of the tree. The stand then is moved forward to bring the base of the tree into abutment with the sharpened edge 22 of the gusset 20 and with the retracted set pin 24. A hammer then is struck against the enlarged head 26 of the set pin 24 and the adjacent portion of the bent segment 18 of post 16, to drive the gusset 20 and set pin 24 into the bottom end of the tree, as illustrated in FIG. 3. The gusset 20 serves to prevent rotation of the tree about the axis of the set pin and hence the body of the tree stand.

The screw crank 38 is removed from its storage position held by the socket 52 and clip 54, and the screw 36 is inserted into the opening 34 at the upper, flattened end 32 of the post 16. The crank segment 42 extends radially outward from the tree and substantially normal to the vertical axis of the tree. A hammer then is impacted against the anvil 46 to drive the screw end 36 into the side of the tree to set the screw threads into engagement with the tree. The second segment 48 of the screw crank 38 extends angularly outward from the tree to facilitate engagement and rotation of the handle end segment 50 by the hand of the installer. The handle end is rotated by the installer to pull the screw threads end 36 into the side of the tree. Continued rotation results in drawing the tree C into close disposition with the post 16.

Removal of the tree stand from the tree is accomplished primarily by reversing the operations described hereinbefore. Thus, the screw crank 38 is removed by counterrotation of the crank to disengage it from the tree. The stand then is pulled axially away from the base of the tree to complete the separation.

It will be apparent to those skilled in the art that various changes may be made in the size, shape, type, number and arrangement of parts described hereinbefore, without departing from the spirit of this invention and the scope of the appended claims.

I claim:

1. In a Christmas tree stand having a base member including a bottom annular ring, a tree-supporting post mounted on the base member and extending upwardly therefrom, a screw crank mounting opening in the upper end portion of the post, and a freely detachable screw crank member having a screw thread section at one end, an enlarged abutment adjacent said screw thread section, and a hand crank at the opposite end, the screw thread section being insertable slidably through said opening in the post for threaded insertion into the side of a tree trunk, the combination therewith of screw crank securing means on the base member including a socket member secured to the ring and configured to removably receive freely therein the screw thread section of the screw crank member, and a clip member secured to the ring and configured to releasably receive a portion of the screw crank member intermediate the screw thread section and the hand crank end thereof for releasably securing the detached screw crank member to the base member for storage when not in use and affording stacking of multiple tree stands for storage and shipment.

2. The combination of claim 1 wherein the clip member is arranged to secure the screw crank member under the clip member by resilient deflection of the screw crank member.

3. The combination of claim 1 wherein the screw crank member is bent intermediate the screw thread end and the handle end, the bend including an outwardly projecting arcuate portion of enlarged radius defining an anvil aligned with the screw thread for striking by a hammer to set the screw thread into the side of a tree trunk.

4. In a Christmas tree stand having a base member including a bottom annular ring, a tree-supporting post mounted on the base member and extending upwardly therefrom, a screw crank mounting opening in the upper end portion of the post, and a screw crank member having a screw thread section at one end and a hand crank at the opposite end, the screw thread section being insertable through said opening in the post for threaded insertion into the side of a tree trunk, the combination therewith of screw crank securing means including a socket member secured to the ring and configured to removably receive the screw thread section of the screw crank member, and a clip member secured to the ring and configured to releasably receive a portion of the screw crank member intermediate the screw thread section and the hand crank end thereof for releasably securing the screw crank member to the base member for storage, the screw crank member being disposed for storage with the socket member receiving the screw thread section and the clip member overlying the screw crank member adjacent the handle end thereof, with the screw crank member extending across an arcuate portion of the ring.

5. The combination of claim 4 wherein the clip member is arranged to secure the screw crank member onto the clip member by resilient deflection of the screw crank member.

6. The combination of claim 4 wherein the screw crank member is bent intermediate the screw thread end and the handle end, the bend including an outwardly projecting arcuate portion defining an anvil aligned with the screw thread for striking by a hammer to set the screw thread into the side of a tree trunk.

* * * * *